US009442508B2

(12) United States Patent
Kochkin et al.

(10) Patent No.: US 9,442,508 B2
(45) Date of Patent: Sep. 13, 2016

(54) REFERENCE VOLTAGE SOURCE AND METHOD FOR PROVIDING A CURVATURE-COMPENSATED REFERENCE VOLTAGE

(75) Inventors: Ivan Victorovich Kochkin, Zelenograd (RU); Sergey Sergeevich Ryabchenkov, Zelenograd (RU)

(73) Assignee: Freescale Semiconductor, Inc., Austin, TX (US)

( * ) Notice: Subject to any disclaimer, the term of this patent is extended or adjusted under 35 U.S.C. 154(b) by 77 days.

(21) Appl. No.: 14/382,559

(22) PCT Filed: Mar. 5, 2012

(86) PCT No.: PCT/RU2012/000160

§ 371 (c)(1),
(2), (4) Date: Oct. 15, 2014

(87) PCT Pub. No.: WO2013/133733

PCT Pub. Date: Sep. 12, 2013

(65) Prior Publication Data

US 2015/0054487 A1 Feb. 26, 2015

(51) Int. Cl.

| | |
|---|---|
| ***G05F 3/16*** | (2006.01) |
| ***G05F 3/24*** | (2006.01) |
| ***G05F 3/20*** | (2006.01) |

(Continued)

(52) U.S. Cl.

CPC . *G05F 3/16* (2013.01); *G05F 3/20* (2013.01); *G05F 3/22* (2013.01); *G05F 3/24* (2013.01); *G05F 3/30* (2013.01)

(58) Field of Classification Search

CPC ..... G05F 3/16

USPC ..... 323/313, 314, 315, 316

See application file for complete search history.

(56) References Cited

U.S. PATENT DOCUMENTS

| | | | |
|---|---|---|---|
| 3,887,863 | A | 6/1975 | Brokaw |
| 6,157,245 | A | 12/2000 | Rincon-Mora |

(Continued)

FOREIGN PATENT DOCUMENTS

| | | | |
|---|---|---|---|
| EP | 1041480 | A1 | 10/2000 |

OTHER PUBLICATIONS

Tsividis, Y.: "Accurate Analysis of Temperature Effects in Ic-Vbe Characteris-20 tics with Application to Bandgap Reference Sources", IEEE journal of solid-state circuits, vol. sc-15, No. 6, Dec. 1980, pp. 1078-1084.

(Continued)

*Primary Examiner* — Jeffrey Gblende
*Assistant Examiner* — Trinh Dang
(74) *Attorney, Agent, or Firm* — Charlene R. Jacobsen

(57) ABSTRACT

A reference voltage source comprises a bandgap voltage reference circuit having a first node and an output node, the output node being arranged for providing a reference voltage. A curvature correction circuit has an input node connected to the output node and/or to a base of a first bipolar device of the bandgap voltage reference circuit and/or to a base of a second bipolar device of the bandgap voltage reference circuit. The curvature correction circuit has an output node connected to the first node of the bandgap voltage reference circuit. The curvature correction circuit comprises a current source for providing a current having a different temperature dependency than a temperature dependency of a first current through the first bipolar device of the bandgap voltage reference circuit.

20 Claims, 4 Drawing Sheets

(51) Int. Cl.
*G05F 3/22* (2006.01)
*G05F 3/30* (2006.01)

(56) References Cited

U.S. PATENT DOCUMENTS

| | | | | |
|---|---|---|---|---|
| 7,710,096 | B2 | 5/2010 | Kotchkine et al. | |
| 2004/0124822 | A1 | 7/2004 | Marinca | |
| 2005/0001651 | A1* | 1/2005 | DiTommaso | 326/32 |
| 2006/0001413 | A1* | 1/2006 | Marinca | 323/315 |
| 2009/0146730 | A1 | 6/2009 | Chen | |
| 2010/0001711 | A1* | 1/2010 | Marinca | 323/313 |
| 2010/0301832 | A1 | 12/2010 | Katyal et al. | |

OTHER PUBLICATIONS

Thomas H. Lee: "Handout #20: EE214 Fa/12002: Voltage References and Biasing", rev. Nov. 27, 2002 (available at www.stanford.edu/class/archive/ee/ee214/ee214.1032/Handouts/ho20bg. pdf).
Malcovati, Piero et al: "Curvature-Compensated BiCMOS Bandgap with 1-V Supply Voltage", IEEE Journal of Solid-State Circuits, vol. 36, No. 7, Jul. 2001, pp. 1076-1081.
International Search Report and Written Opinion correlating to PCT/RU2012/000160 dated Dec. 6, 2012.

* cited by examiner

REFERENCE VOLTAGE SOURCE AND METHOD FOR PROVIDING A CURVATURE-COMPENSATED REFERENCE VOLTAGE

FIELD OF THE INVENTION

This invention relates to a reference voltage source and a method for providing a curvature-compensated reference voltage.

BACKGROUND OF THE INVENTION

In many applications voltage reference circuits operate under strongly changing temperature conditions.

U.S. Pat. No. 3,887,863 discloses to controllably operate two transistors at markedly different emitter current densities for deriving a temperature-independent reference voltage. A control loop may be used to force the collector currents of the two transistors to be equal. The two transistors may have different sizes of emitter areas. A first resistor connecting the emitter of a first of both transistors to ground of a DC power supply may be used to generate a voltage across the first resistor which may be proportional to absolute temperature (PTAT).

As described in Tsividis, Y.: "*Accurate Analysis of Temperature Effects in $I_C$-$V_{be}$ Characteristics with Application to Bandgap Reference Sources*", IEEE journal of solid-state circuits, vol. sc-15, no 6, December 1980, page 1078-1084, the base emitter voltage $V_{be}$ of a transistor, in particular a bipolar transistor, may exhibit a dependence on the absolute temperature T which can be described with the mathematical formula (Equation 1):

$$Vbe_{Q1} = V'_{G0} - \frac{V'_{G0} - Vbe_{Q1R}}{T_R} \cdot T - V_T \cdot (n - x_1) \cdot \ln\left(\frac{T}{T_R}\right),$$

where:

$V'_{G0}$ represents a bandgap voltage of a semiconductor material, extrapolated to 0 degrees Kelvin; the semiconductor material may be silicon;

$V_{beR}$ represents a base-emitter voltage at temperature $T_R$;

$V_T$=kT/e represents a thermodynamic voltage, wherein k represents the Boltzmann constant, and e represents the electron charge;

T represents an absolute temperature in Kelvin;

$T_R$ represents a reference temperature in Kelvin;

n represents a process-dependent parameter; n represents a temperature-independent parameter; n may be 4 minus the power of a temperature dependency of an (effective) mobility for minority carriers;

and $x_1$ may represent a power of temperature dependency of the collector current of the first transistor under operating conditions. $x_1$ may depend on the bias current; it may, e.g., be 1 if the bias current is proportional to absolute temperature or may be 0 when the current is temperature-independent.

As can be seen from the term $V_{NL}=-V_T(n-x_1)\ln(T/T_R)$ in Equation 1, the base-emitter voltage $V_{be}(T)$ may exhibit a non-linear dependency over temperature T. This term may change the output voltage of a conventional Brokaw cell in an undesired manner. Usually, the factor $(n-x_1)$ cannot be set to zero to compensate for the non-linear term.

Thomas H. Lee: "*Handout #20: EE214 Fall 2002: Voltage References and Biasing*", rev. Nov. 27, 2002 (available at www.stanford.edu/class/archive/ee/ee214/ee214.1032/Handouts/ho20bg.pdf) discloses that the parameter n is typically a minimum of 2 and range up to about 6. Usually, the parameter n may be close to 4. Typical values of $(n-x_1)$ may range from 1 to 5, and usually may be close to 3. Even if the value of $(n-x_1)$ was 1, the term $V_{NL}=(n-x_1)\ V_T \ln(T/T_R)$ would be still non-linear and would still be not zero. The temperature drift of a conventional Brokaw cell caused by the non-linear term $V_{NL}$ is typically not higher than 1% of the output voltage $V_{OUT}$.

SUMMARY OF THE INVENTION

The present invention provides a reference voltage source and a method for providing a reference voltage, as described in the accompanying independent claim.

Specific embodiments of the invention are set forth in the dependent claims.

These and other aspects of the invention will be apparent from and elucidated with reference to the embodiments described hereinafter.

BRIEF DESCRIPTION OF THE DRAWINGS

Further details, aspects and embodiments of the invention will be described, by way of example only, with reference to the drawings. In the drawings, like reference numbers are used to identify like or functionally similar elements. Elements in the figures are illustrated for simplicity and clarity and have not necessarily been drawn to scale.

DETAILED DESCRIPTION OF THE PREFERRED EMBODIMENTS

Because the illustrated embodiments of the present invention may for the most part, be implemented using electronic components and circuits known to those skilled in the art, details will not be explained in any greater extent than that considered necessary for the understanding and appreciation of the underlying concepts of the present invention and in order not to obfuscate or distract from the teachings of the present invention.

Figure 1:
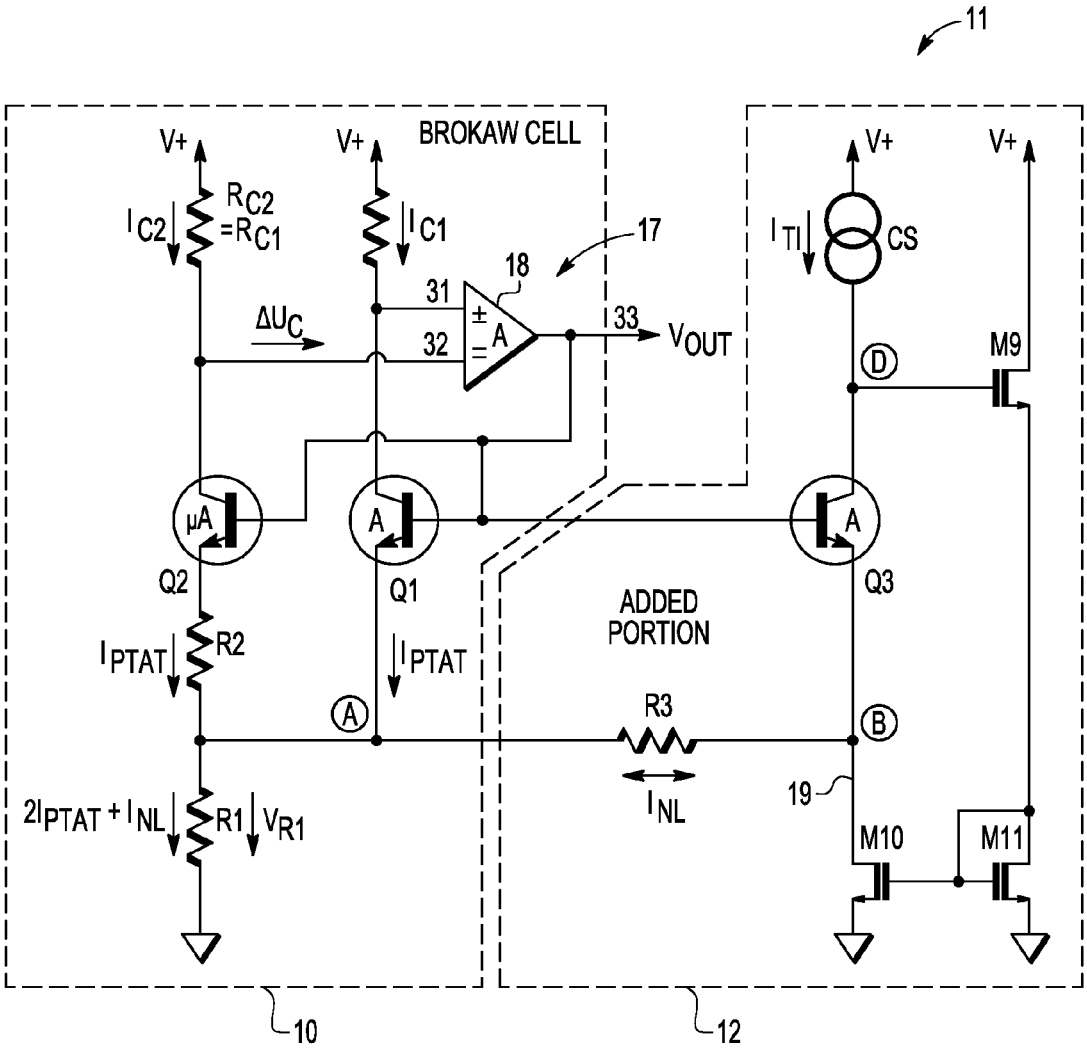
FIG. 1 schematically shows a circuit diagram first example of an embodiment of a Brokaw cell.
Figure 3:
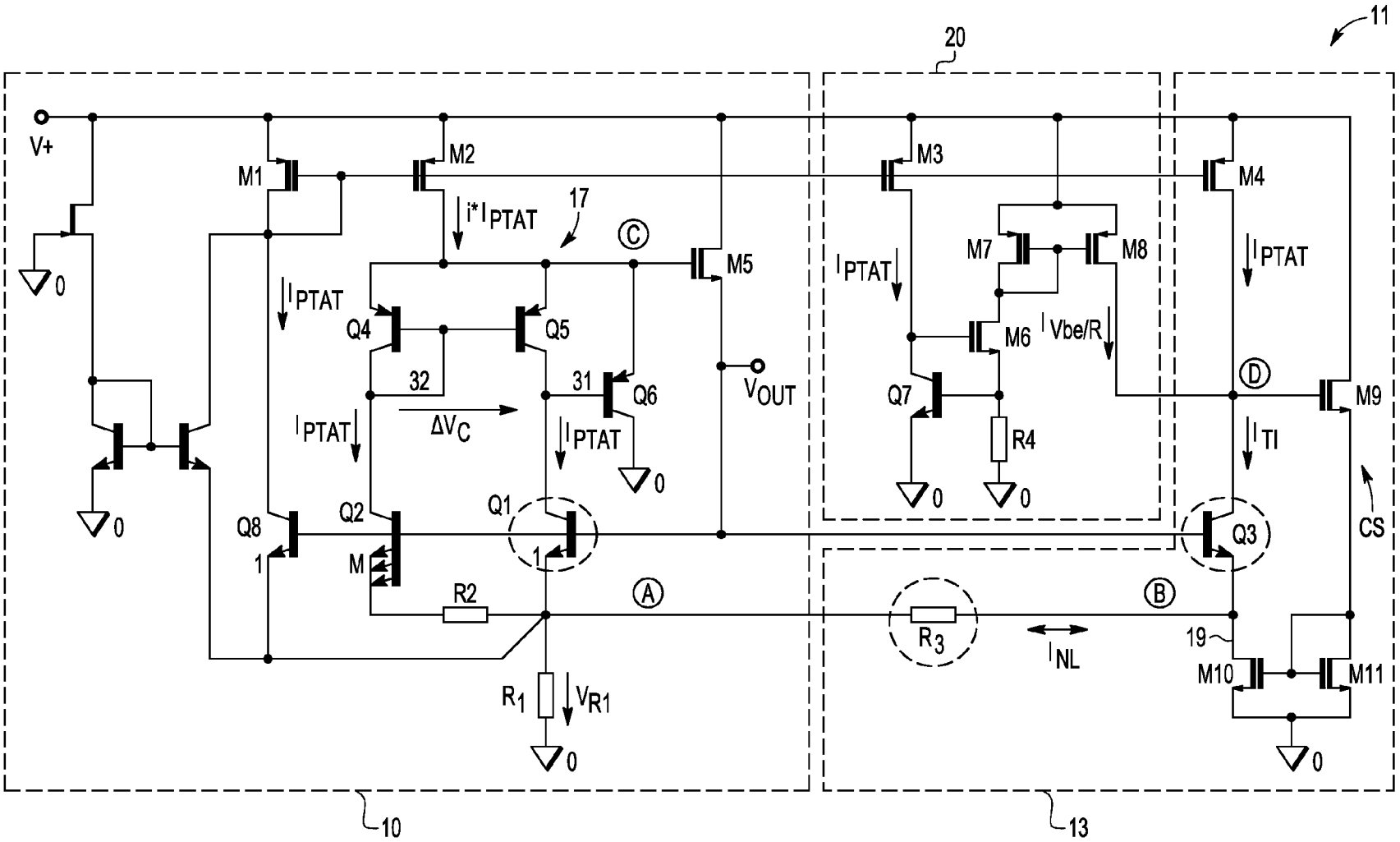
FIG. 3 schematically shows a circuit diagram second example of a Brokaw cell.

The examples of a reference voltage source 11 shown in FIGS. 1 and 3 comprise a bandgap voltage reference circuit 10 having a first node A and an output node $V_{OUT}$. The output node $V_{OUT}$ is arranged for providing a reference voltage $V_{OUT}$.

The bandgap voltage reference circuit 10 may be implemented in any manner suitable for the specific implementation, and as described in more detail below, for example comprise a first Q1 and a second Q2 bipolar device arranged to work with different emitter current densities J1, J2. The emitter of the first bipolar device Q1 and/or the emitter of the second bipolar device Q2 may be connected to the first node A. The first node A may for example be positioned between the emitter of the first bipolar device Q1 and the emitter of the second bipolar device Q2.

The bandgap voltage reference circuit 10 may, for example, comprise a first resistor R1 positioned between the emitter of the first bipolar device Q1 and a first terminal gnd of a power supply. The bandgap voltage reference circuit 10 may comprise a second resistor R2 between the emitters of the bipolar devices Q1, Q2. The second resistor R2 may for example be arranged between node A and the emitter of the first bipolar device Q1 and/or the emitter of the second bipolar device Q2.

The source 11 may further comprise a curvature correction circuit 12. The curvature correction circuit 12 may be implemented in any manner suitable for the specific implementation. The curvature correction circuit may have an input line connected to the output node $V_{OUT}$ of the bandgap voltage reference circuit 10 and/or to a first transistor, e.g. the base of a first bipolar device Q1, and/or to a second transistor, e.g. to a base of a second bipolar device Q2, of the bandgap voltage reference circuit 10. The curvature correction circuit 12 may have an output line connected to the first node A of the bandgap voltage reference circuit 10.

The curvature correction circuit 12 may comprise, as shown, a current source CS for providing a current $I_{TI}$. The current $I_{TI}$ may have a different temperature dependency $x_3$ than a temperature dependency $x_1$ of a first current $I_{C1}$ through the first bipolar device Q1 of the bandgap voltage reference circuit 10.

The curvature correction circuit 12 may for example comprise a third bipolar device Q3. The third bipolar device Q3 may be arranged to work with emitter current density J3, which may, for example, be equal to the current density J1 of the first bipolar device Q1 at reference temperature $T_R$.

The bipolar devices may be connected in any manner suitable for the specific implementation. For example, a collector of the third bipolar device Q3 may be connected to the current source CS. Also, the base of at least one of the first bipolar device Q1 and the second bipolar device Q2 may be connected to the output node $V_{OUT}$ as well as the base of the third bipolar device Q3, for example a third resistor R3 may form a link between an emitter of the third bipolar device Q3 and the first node (A) of the reference voltage source 11. Also, the base of the third bipolar device Q3 may be connected, in addition or alternatively to the output node VOUT, to the base of the first bipolar device Q1 and/or the base of the second bipolar device Q2.

The curvature correction circuit 12 may comprise a third branch having a third transistor Q3 and a current source CS. The collector of the third transistor Q3 may be connected to the current source CS. A third resistor R3 may connect the emitter of the third transistor Q3 to the first node A of the Brokaw cell. The base terminals of all three transistors Q1, Q2, Q3 may be connected to each other. All three transistors may be realized on a same die. At least one of the first Q1, second Q2, and third Q3 transistors may be a bipolar transistor. At least one of the first Q1, second Q2, and third Q3 transistors may be an npn transistor. All transistors Q1, Q2, Q3 may be made of transistors of a same built. At least one of the first R1, second R2, and third R3 resistors may be exclusively composed of Ohmic resistances.

The reference voltage source 11 may comprise a first branch, a second branch, and a third branch, for instance connected in parallel. Each of the three branches may be fed by a common power supply V+.

For example, the first branch may comprise a first transistor Q1. An emitter of the first transistor Q1 may be connected to a first resistor R1. The second branch may comprise a second transistor Q2. An emitter of the second transistor Q2 may be connected to a first side of the second resistor R2. The first node A may be connected to the other side of the second resistor R2, to the emitter of the first transistor Q1, and to the first resistor R1.

The reference voltage source 11 may comprise a feedback control 17, which may have a first 31 and a second 32 input terminal. The first input terminal 31 may be prepared to be fed by a signal representative for strength of a collector current $I_{C1}$ through the first branch. The second input terminal 32 may be prepared to be fed by a signal representative for strength of a collector current $I_{C2}$ through the second branch. An output terminal 33 of the feedback control 17 may be connected to a base of the first transistor Q1 and to a base of the second transistor Q2.

A third branch may comprise a third transistor Q3 and a current source CS. A collector of the third transistor Q3 may be connected to the current source CS. A third resistor R3 may form a link between the emitter of the third transistor Q3 and the first node A. A base of the third transistor $Q_3$ may be connected to a base of the first transistor $Q_1$.

Describing the example of FIG. 1 in more detail, the example of a reference voltage source shown therein comprises as a bandgap voltage reference circuit 10 a Brokaw cell and a curvature correction circuit 12 for generating a correction current $I_{NL}$. The reference voltage source 11 may be considered as a 'Brokaw' cell.

As shown in FIG. 1, the bandgap voltage reference circuit 10 may comprise two bipolar devices Q1, Q2 (which may be transistors), a feedback control 17, a resistor $R_{C1}$ connected between a power supply line and the collector of transistor Q1, a resistor $R_{C2}$ connected between the power supply line and the collector of transistor Q2, a first resistor R1, and a second resistor R2. The transistors Q1 and Q2 may be bipolar transistors. Generally, the first bipolar device Q1 and the second bipolar device Q2 of the bandgap voltage reference circuit 10 may be considered to work with different emitter current densities. There may be provided a resistor R2 between the first bipolar device Q1 and the second bipolar device Q2, in particular between the emitter of the first bipolar device Q1 and the emitter of the second bipolar device Q2.

The collector currents $I_{C1}$, $I_{C2}$ through the transistors Q1 and Q2 may be equalized by a feedback control 17. The resistor $R_{C1}$ may form a link between a power supply V+ and the collector of the first transistor Q1. The resistor $R_{C2}$ may form a link between the power supply V+ and the collector of the second transistor Q2. The collector current $I_{C1}$ through resistor $R_{C1}$ may generate a first voltage drop across resistor $R_{C1}$. The collector current $I_{C2}$ through resistor $R_{C2}$ may generate a second voltage drop across resistor $R_{C2}$. The base of the second transistor Q2 may be connected to the base of the first transistor Q1.

The feedback control 17 may be arranged to control a voltage difference ΔVc of the two voltages across the resistors $R_{C2}$ and $R_{C1}$ to zero. The feedback control 17 may comprise an operational amplifier 18. A first line 31 of a differential input 31, 32 of the feedback control 17 may be connected to the collector of the first transistor Q1. A second line 32 of a differential input 31, 32 of the feedback control 17 may be connected to the collector of the second transistor Q2. The first line 31 may be a positive input of the feedback control 17. The second line 32 may be a negative input of the feedback control 17. The output of the feedback control 17 may be connected to the base of the first transistor Q1 and to the base of the second transistor Q2.

A base-emitter voltage $V_{beQ1}$ of the first transistor Q1 may be provided by a base-emitter section of the first transistor Q1 through which the collector current $I_{C1}$ may be led. A base-emitter voltage $V_{beQ2}$ of the second transistor Q2 may be provided by a base-emitter section of the second transistor Q2 through which the collector current $I_{C2}$ may be led.

The transistors Q1, Q2 may have emitter areas of different size $A_{e1}$ and $A_{e2}$, respectively. An emitter area of the first transistor Q1 may have a first size $A_{e1}$. An emitter area of the second transistor Q2 may have a second size $A_{e2}$ higher than the first size $A_{e1}$ of the emitter area of the first transistor Q1. In the following, a ratio $A_{e2}/A_{e1}$ between the size $A_{e2}$ of the emitter area of the second transistor Q2 and the size $A_{e1}$ of the emitter area of the first transistor Q1 is designated by β. The factor β may be higher than 1; in particular, the factor β may be for example 7 or 8, or may have any other value higher than 1. When the collector currents $I_{C1}$, $I_{C2}$ of the transistors Q1 and Q2 are equal, the base currents of transistor Q1 and transistor Q2 may have a same value (even when the emitter sizes $A_{e1}$ and $A_{e2}$ of both transistors may differ by the factor β). From all this may result, that an emitter current density J2 of the transistor Q2 may be by the factor of β smaller than an emitter current density J1 of the transistor Q1 when the collector currents $I_{C1}$, $I_{C2}$ of the transistors Q1 and Q2 were equal. For avoiding unnecessary deviations of other parameters (than the emitter sizes $A_{e1}$ and $A_{e2}$) between the transistors Q1 and Q2, the transistor Q2 may be realized by duplication, i.e. by several transistors connected to each other in parallel and having a same built as that of transistor Q1.

A first resistor R1 of the bandgap voltage reference circuit 10 may form a link between a first (circuit) node A and ground. The emitter of the first transistor Q1 may be connected to the first node A. A second resistor R2 may form a link between the emitter of the second transistor Q2 and the first node A.

The curvature correction circuit 12 may comprise a current source CS, a third bipolar device Q3 (which may be a transistor), and a third resistor R3. The third transistor Q3 may be a bipolar transistor. It may be considered that the curvature correction circuit 12 is connected to the bandgap voltage reference circuit via an input node, which may be connected to the base of first transistor Q1 and/or the base of second transistor Q2 and/or the output of the feedback control 17, which may be considered to be an output node $V_{OUT}$. The transistors Q1, Q3 may have emitter areas of a same size $A_{e1}=A_{e3}$. For avoiding unnecessary deviations of other parameters between the first and the second transistor Q1 and Q3, the transistor Q3 may have a same built as that of transistor Q1. Should the emitter areas of transistors Q1, Q3 have different sizes $A_{e1}$, $A_{e3}$, the strength of the collector current $I_{TI}$ from the current source CS may be different compared to the strength of the collector current $I_{C1}$ of the first transistor Q1. The collector current $I_{TI}$ through transistor Q3 may have a different temperature dependency $x_3$ than the collector current $I_{C1}$ of transistor Q1. When $x_1$ is substituted by $x_3$ Equation 1 can be used for calculating the base emitter voltage $V_{beQ3}$ of transistor Q3. $x_3$ may represent a power of temperature dependency of the collector current of the third transistor under operating conditions.

The current source CS may comprise a modified Wilson current mirror. The modified Wilson current mirror may comprise transistors M9, M10, and M11. The base of the third transistor Q3 may be connected to the base of the first transistor Q1. The third resistor R3 may form a link between the first node A and a second (circuit) node B of the correction circuit 12. This link may be considered to be an output node connecting the curvature correction circuit 12 to the first node A of the bandgap reference voltage circuit. The emitter of the third transistor Q3 may be connected to the second node B. An output node 19 of the modified Wilson current mirror comprising transistors M9, M10, M11 may be connected to the emitter of the third transistor Q3 (i.e. to the second node B).

The current source CS may provide a current $I_{TI}$ having a different temperature dependency $x_3$ than a temperature dependency $x_1$ of the collector current $I_{C1}$ through the first branch. The current source CS may provide a constant, temperature-independent current $I_{TI}$. The constant, temperature-independent current $I_{TI}$ may flow through the collector section of the third transistor Q3. The third transistor Q3 may provide a base-emitter voltage $V_{beQ3}$. The base-emitter voltage $V_{beQ3}$ may be caused by the temperature-independent current $I_{TI}$ flowing through the collector of the third transistor Q3.

Figure 2:
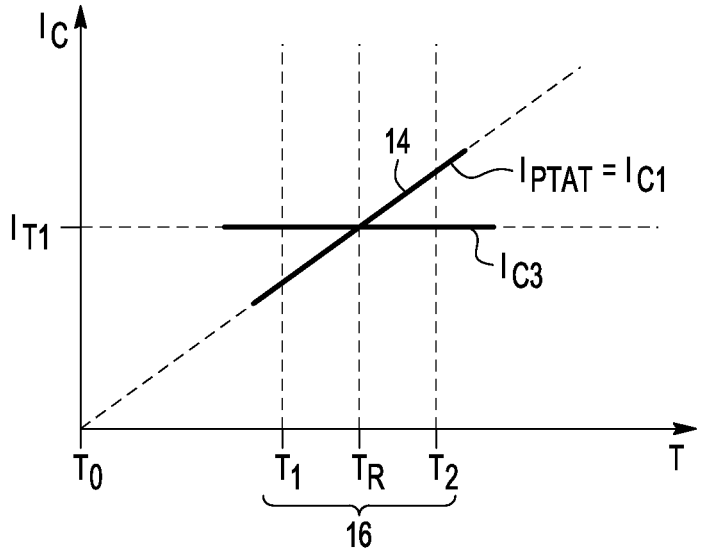
FIG. 2 schematically shows a graph of the collector current of the first and third transistor of the first example as a function of temperature.

FIG. 2 shows a curve 14 of the collector current $I_{C1}$ of the first transistor Q1 as a function of temperature T. Temperature $T_0$ marks absolute zero (0 K). Temperatures $T_1$ and $T_2$ mark lower and upper limits of an operating range 16 of the reference voltage source 11. $T_R$ represents a reference temperature.

Within the operating range 16, the collector current $I_{C1}$ of the first transistor Q1 may be PTAT (=proportional to absolute temperature T), while the collector current $I_{TI}$ of the third transistor Q3 may be approximately constant. Both collector currents $I_{C1}$, $I_{TI}$ may be equal at the reference temperature $T_R$. The reference temperature $T_R$ may be within the operating range 16. The reference temperature $T_R$ may be positioned at about the middle of the operating range 16, i.e. $T_R-T_1$ equaling $T_2-T_R$.

Transistors Q1 and Q3 may be selected and arranged such that at the reference temperature $T_R$, the emitter current density J1 of transistor Q1 is equal to the emitter current density J3 of transistor Q3. Generally, the dependency of a current from temperature T be parameterized or approximated as $T^{xn}$. Different temperature dependencies of currents (in particular the collector currents $I_{C1}$, $I_{C2}$, $I_{C3}$ of transistors Q1, Q2, Q3) may be represented by different values of $x_n$. For example, if $x_1 \neq x_3$, it may be considered that the current $I_{C1}$ of transistor Q1 has a different temperature dependency than the current $I_{TI}$ of transistor Q3. For a temperature-independent current, $x_n$ may be 0, whereas for a current proportionally to temperature, $x_n$ may be 1.

Using Equation 1:

$$Vbe_{Q1} = V'_{G0} - \frac{V'_{G0} - Vbe_{Q1R}}{T_R} \cdot T - V_T \cdot (n - x_1) \cdot \ln\left(\frac{T}{T_R}\right),$$

which is also valid analogously for transistor Q3, and supposing that the size $A_{e3}$ of the emitter area of the third transistor Q3 was equal to the size $A_{e1}$ of the emitter area of the first transistor Q1, the voltage difference between the first node A and the second node B may be described by following Equation 2:

$$Vbe_{Q1} - Vbe_{Q3} = -(V_A - V_B) = V_T \cdot (x_1 - x_3) \cdot \ln\left(\frac{T}{T_R}\right),$$

where $x_3$ may represent a power of a temperature dependency of the collector current $I_{TI}$ of the first transistor Q3 under operating conditions. $x_3$ may depend on the bias current of the third transistor Q3; it may, e.g., be 1 if the bias current is proportional to absolute temperature T or may be 0 when the current is temperature-independent.

If transistors $Q_1$ and $Q_3$ have different temperature dependencies ($x_1 \neq x_3$), a voltage difference may occur, depending on the temperature T. A correction current $I_{NL}=(Vbe_{Q1}-Vbe_{Q3})/R3$ may then flow through the third resistor R3, i.e. when the temperature T is different to the reference temperature $T_R$. For generating such a correction current $I_{NL}$, the power $x_3$ (of the temperature dependency of the collector current $I_{TI}$) may be different to the power $x_1$ (of the temperature dependency of the collector current $I_{C1}$). In a basic example embodiment $x_1$ equals 1 and $x_3$ equals 0.

The current $I_{NL}$ may be bidirectional. The correction current $I_{NL}$ may flow from the first node A to the second node B when the temperature T is lower than a reference temperature $T_R$. The correaction current $I_{NL}$ may flow from the second node B to the first node A when T is higher than the reference temperature $T_R$. At the reference temperature $T_R$, the correction current $I_{NL}$ may be zero.

Using the previous information, a reference voltage $V_{OUT}$ with exact curvature compensation may be derived to be:

$$V_{OUT} = Vbe_{Q1} + 2\cdot\frac{R1}{R2}\cdot V_T\cdot\ln(N) + (x_1 - x_3)\cdot\frac{R1}{R3}\cdot V_T\cdot\ln\left(\frac{T}{T_R}\right)$$

$$= \underbrace{\frac{V'_{G0}}{1}}_{1} - \underbrace{\frac{V'_{G0} - Vbe_{Q1R}}{T_R}\cdot T}_{2} + \underbrace{2\cdot\frac{R1}{R2}\cdot V_T\cdot\ln(N)}_{3} - \underbrace{V_T\cdot(n - x_1)\cdot\ln\left(\frac{T}{T_R}\right)}_{4} + \underbrace{(x_1 - x_3)\cdot\frac{R1}{R3}\cdot V_T\cdot\ln\left(\frac{T}{T_R}\right)}_{5}.$$

The first term 1 of this equation may be constant. The second and third terms 2, 3 may be linear terms. The linear temperature-dependency of the second and third terms 2, 3 may be compensated by the bandgap voltage reference circuit 10 of the Brokaw cell 12. The fourth and fifth terms 4, 5 may be non-linear terms. The non-linear temperature-dependency of the output voltage $V_{OUT}$ may be compensated, when a sum of the non-linear terms are cancelled. This may be achieved when following applies:

$$V_T\cdot(n - x_1)\cdot\ln\left(\frac{T}{T_R}\right) = (x_1 - x_3)\cdot\frac{R1}{R3}\cdot V_T\cdot\ln\left(\frac{T}{T_R}\right) \Rightarrow R3 = \frac{x_1 - x_3}{n - x_1}\cdot R1.$$

If this condition is fulfilled the reference voltage $V_{OUT}$ may become constant as a function of temperature.

The collector currents $I_{C1}$, $I_{C2}$ through the transistors Q1 and Q2 may be completely controlled by the feedback control 17 of the bandgap voltage reference circuit 10 of the reference voltage source 11. The correction current $I_{NL}$ may flow exclusively through resistors R1 and R3 (not through RC1 or RC2). The output voltage $V_{OUT}$ of the reference voltage source 11 may amount to $V_{OUT}=V_{beQ1}+V_{R1}$. According to the law of superposition, the correction current $I_{NL}$ may modify the voltage $V_{R1}$ at resistor R1 by $\Delta V_{R1}=I_{NL}*R1=-(R1/R3)\ V_T\ \ln\ (T/T_R)=-((n-x_1)/(x_1-x_3))\ V_T \ln\ (T/T_R)$.

Should the temperature T be higher than the reference temperature $T_R$, the base-emitter voltage $V_{beQ1}$ may be lower than at the reference temperature $T_R$ and/or lower than the base-emitter voltage $V_{beQ3}$ of Q3. Should the temperature T be higher than the reference temperature $T_R$ the correction current $I_{NL}$ may flow from the second node B to the first node A. The non-linear portion of decrease of the base-emitter voltage $V_{beQ1}$ of the first transistor Q1 caused by the temperature difference between T and $T_R$ may be compensated by an increase $\Delta V_{R1}$ of the voltage $V_{R1}$ at resistor R1 by $\Delta V_{R1}=I_{NL}*R1$ such that the output voltage $V_{out}$ is kept constant.

Should the temperature T be lower than the reference temperature $T_R$, the base-emitter voltage $V_{beQ1}$ may be higher than at the reference temperature $T_R$ and/or higher than the base-emitter voltage $V_{beQ3}$ of Q3. Should the temperature T be lower than the reference temperature $T_R$, the correction current $I_{NL}$ may flow from the first node A to the second node B. The non-linear portion of increase of the base-emitter voltage $V_{beQ1}$ of the first transistor Q1 at temperature T compared to the reference Temperature $T_R$ may be compensated by a decrease $\Delta V_{R1}$ of the voltage $V_{R1}$ at resistor R1 by $\Delta V_{R1}=I_{NL}*R1$ such that the output voltage $V_{out}$ is kept constant.

FIG. 3 schematically shows a second example embodiment of a reference voltage source 11. The reference voltage source 11 may comprise a Brokaw 1st-order bandgap voltage reference 10, a $V_{be}$/R bias source 20, and a curvature compensation circuit 13.

A circuit comprising transistors Q8, M1, M2 may copy the collector current $I_{C1}$ being proportional to absolute temperature (PTAT) to a collector current $I_c$ which may have i times the value of the collector current $I_{C1}$. The factor i may depend on characteristics of transistors Q4 to Q6 of the feedback control circuit 17 described below. For example, if the transistors Q4 to Q6 were BJTs, the factor i may be 4 (for compensation of base current effects of transistors Q4, Q5 by a base current of Q6). If the transistors Q4 to Q6 were MOSFETs, the factor i may be 3 (to equalize voltages on collectors of transistors Q1 and Q2).

The feedback control 17 may comprise a current mirror comprising transistors Q4, Q5. The base of a transistor Q6 may be connected to the collector of transistor Q1. The collector of transistor Q6 may be connected to ground. The emitter of transistor Q6 may be connected to a third (circuit) node C. The gate of a transistor M5 may be connected to the node C. The drain of transistor M5 may be connected to the power supply V+. The source of transistor M5 may be connected to the base of the first transistor Q1 and to an output terminal for the reference voltage $V_{OUT}$. The transistors Q4, Q5, and Q6 may be p-type MOS devices.

An increase of the base-emitter voltage $V_{beQ1}$ of the first transistor Q1 may cause following. The collector current $I_{C1}$ may increase. A voltage drop across the collector-emitter section of transistor Q5 may increase. A base voltage of transistor Q6 may decrease. Strength of a collector current through transistor Q6 may increase. A gate voltage of transistor M5 may decrease. A voltage drop across the channel of transistor M5 may decrease. The output voltage $V_{OUT}$ and the base-emitter voltage $V_{beQ1}$ may decrease.

A decrease of the base-emitter voltage $V_{beQ1}$ of the first transistor Q1 may cause following. The collector current $I_{C1}$ may decrease. A voltage drop across the collector-emitter section of transistor Q5 may decrease. A base voltage of transistor Q6 may increase. A strength of an emitter collector current through transistor Q6 may decrease. A gate voltage of transistor M5 may increase. A voltage drop across the channel of transistor M5 may increase. The output voltage $V_{OUT}$ and the base-emitter voltage $V_{beQ1}$ may increase.

Due to the current mirror comprising the transistors Q4 and Q5, the collector current of the second transistor Q2 may be maintained equal to the collector current $I_{C1}$ of the first transistor Q1.

As shown in the example of FIG. 3, a current source CS may be provided to generate a temperature-independent current $I_{TI}$ by summing up a current $I_{Vbe/R}$ having a negative temperature variation coefficient and a current having a positive temperature variation coefficient. The current $I_{PTAT}$ having a positive temperature variation coefficient may be proportional to absolute temperature T.

The reference voltage source 11 may comprise a circuit Q8, M1, M3 for controlling an input current $I_{PTAT}$ of the Vbe/R bias source 20 in dependency of a strength of at least one of the collector current $I_{C1}$ through the first branch and the collector current $I_{C2}$ through the second branch. The circuit may control the current in any manner suitable for the specific implementation, for example by switching on and off a current the (average) strength of the current switched may be controlled. The control may be performed continuously, and for example based on a control current or control voltage provided to a control electrode of a transistor. Referring to the shown example, a circuit comprising transistors Q8, M1, M3 may copy the collector current $I_{C1}$ being proportional to absolute temperature (PTAT) to a channel current of transistor M3. The channel current $I_{PTAT}$ of transistor M3 may be employed as input current of the $V_{be}$/R bias source 20.

The $V_{be}$/R bias source 20 may comprise transistors Q7 and M6. The channel current $I_{Vbe/R}$ of transistor M6 may be employed as output current of the $V_{be}$/R bias source 20. A current mirror comprising transistors M7 and M8 may mirror the output current $I_{Vbe/R}$ of the $V_{be}$/R bias source 20. The current $I_{Vbe/R}$ from the channel of transistor M8 may be supplied to a fourth (circuit) node D of the curvature compensation circuit 13.

The reference voltage source 11 may comprise a circuit Q8, M1, M4 for controlling the output current $I_{PTAT}$ which may be proportional to absolute temperature T, in dependency of a strength $I_{PTAT}$ of at least one of the collector current $I_{C1}$ through the first branch and the collector current $I_{C2}$ through the second branch. A circuit comprising transistors Q8, M1, M4 may copy the collector current $I_{C1}$ being proportional to absolute temperature (PTAT) to a channel current of transistor M4.

The current source CS may comprise a fourth node D for summing up an output current $I_{Vbe/R}$ of the Vbe/R bias source 20 and the output current $I_{PTAT}$ of the current source for providing a current $I_{PTAT}$, which may be proportional to absolute temperature T. The current $I_{PTAT}$ from the channel of transistor M4 may be supplied to the fourth node D of the curvature compensation circuit 13. According to Kirchhoffs current law the fourth node D may force the collector current $I_{TI}$ to be a sum of the mirrored output current $I_{Vbe/R}$ of the Vbe/R bias source 20 and of the copied current $I_{PTAT}$ proportional to absolute temperature T.

The curvature compensation circuit 13 may comprise a current mirror comprising transistors M9, M10, M11. The current mirror comprising transistors M9, M10, M11 may be designated as a modified Wilson current mirror. A gate of a control transistor M9 of the modified Wilson current mirror M9, M10, M11 may be connected to the collector of the third transistor Q3. The collector of the third transistor Q3 may be connected to the fourth node D. An output node 19 of the modified Wilson current mirror M9, M10, M11 may be connected to the emitter of the third transistor Q3. The emitter of the third transistor Q3 may be connected to the second node B. Transistor M10 may form a link between the circuit note B and ground. Transistor M10 may be the output transistor of the current mirror comprising transistors M9, M10, M11.

The base of the third transistor Q3 may be connected to the base of the first transistor Q1. The third resistor R3 may form a link between the first node A and the second node B of the curvature compensation circuit 13. The emitter of the third transistor Q3 may be connected to the second node B. An output node 19 of the current mirror comprising transistors M9, M10, M11 may be connected to the second node B.

As shown in FIG. 3 the transistors Q1, Q2, Q3, Q7, and Q8 may be npn bipolar transistors. The transistors Q4, Q5, and Q6 may be pnp bipolar or p-type field effect transistors. The transistors M1, M2, M3, M4, M7, and M8 may be p-type field effect transistors. The transistors M5, M6, M9, M10, and M11 may be n-type field effect transistors. The npn transistors may be substituted by pnp transistors, when the pnp transistors are substituted by npn transistors.

The curvature compensation circuit 13 may be arranged to provide a current $I_{TI}$ having a different temperature dependency $x_3$ than a temperature dependency $x_1$ of the collector current $I_{C1}$ through the first branch. The current may be a constant, temperature-independent current $I_{TI}$. The constant, temperature-independent current $I_{TI}$ may flow through the collector of the third transistor Q3. The third transistor Q3 may provide a base-emitter voltage $V_{beQ3}$. The base-emitter voltage $V_{beQ3}$ may be caused by the temperature-independent current $I_{TI}$ flowing through the collector of the third transistor Q3.

By applying the correction current $I_{NL}$ to the first node A, a temperature dependency of an reference voltage source 11 may be theoretically eliminated. Simulations demonstrated that the output voltage $V_{OUT}$ of the reference voltage source 11 according to the second example embodiment (see FIG. 3) has an extremely low temperature dependency compared to the conventional 1st-order bandgap voltage reference circuit 10. In practice, the temperature dependency of an reference voltage source 11 may be reduced by a factor of for example at least 5, at least 10, at least 20, or at least 30 compared to a temperature dependency of a conventional bandgap voltage reference circuit 10. The temperature dependency of the reference voltage source 11 may be reduced by employing resistors R1, R2, R3, and R4 having a same temperature dependency.

Each of the first, second and third branches may be operable to be supplied by a voltage supply V+. At least two of the first, second and third branches may be connected in parallel to be operable at a common power supply V+.

The first example embodiment, the second example embodiment, or any other embodiment of the reference voltage source 11 may be realized as a portion of a simulation tool. In this case voltages and currents may be represented by numerical values.

Figure 4:
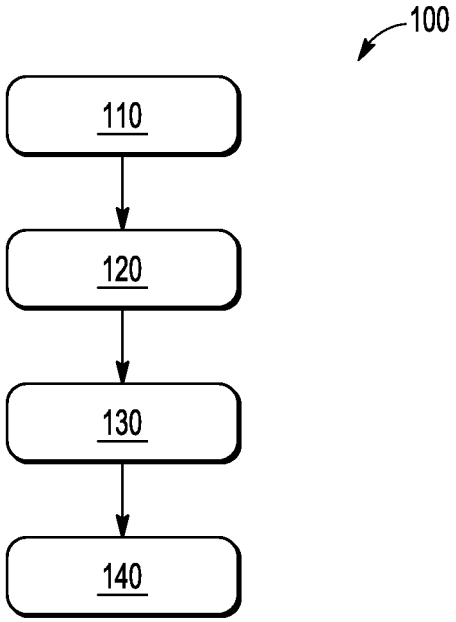
FIG. 4 schematically shows a flow diagram of an example of a method for providing a reference voltage.

Referring now to the flow-chart of FIG. 4, a method 100 of providing a reference voltage $V_{OUT}$ may comprise, as illustrated at 110, providing a reference voltage source 11 having a first Q1, a second Q2, and a third Q3 transistor. The second transistor Q2 may have a larger emitter size $A_{e2}$ than the first transistor Q1. The bases of all three transistors Q1, Q2, Q3 may be connected to each other. The emitter of the first transistor Q1 may be connected to a first node A. A second resistor R2 may form a link between the emitter of the second transistor Q2 and the emitter of the first transistor Q1. A third resistor R3 may form a link between the emitter of the third transistor Q3 and the emitter of the first transistor Q1. A first resistor R1 may form a link between the first node A and a first terminal gnd of a power supply (which may be a ground terminal). As illustrated at 120, the method may comprise providing, as illustrated at 120, a first collector current $I_{C1}$ through a collector of a first transistor Q1. A value of the first collector current $I_{C1}$ may have a first temperature dependency $x_1$. The temperature dependency of a collector current of first transistor Q1 may be proportional to absolute temperature T. The parameter $x_1$ representing the first temperature dependency may be 1 if current $I_{e1}$ is proportional to absolute temperature T. As illustrated at 130, the method 100 may comprise providing a second collector current $I_{C2}$ through a collector of a second transistor Q2. The second collector current $I_{C2}$ may have a same value as the first collector current $I_{C1}$. As illustrated at 140, a third current $I_{TI}$ may be provided through a collector of a third transistor Q3. A value of the third current $I_{TI}$ may have a second temperature dependency, which may be represented by $x_3$. The second temperature dependency $x_3$ may be different to the first temperature dependency $x_1$. If $I_{C1}$ is proportional to absolute temperature T(×1=1), the parameter $x_3$ representing the second temperature dependency of the third current $I_{TI}$ may be 0 or not 1, generally representing a case in which the current $I_{TI}$ is not proportional to absolute temperature T.

When using the method 100, a value of the third resistor R3 divided by the value of the first resistor R1 may be $(x_1-x_3)/(n-x_1)$. $x_1$ may represent a power of a temperature dependency of the collector current of the first transistor Q1. $x_3$ may represent a power of temperature dependency of the collector current of the third transistor Q3. n may have the value of 4 minus the power of a temperature dependency of a mobility for minority carriers.

In the foregoing specification, the invention has been described with reference to specific examples of embodiments of the invention. It will, however, be evident that various modifications and changes may be made therein without departing from the scope of the invention as set forth in the appended claims and that the claims are not limited to the specific examples described. For example, the connections as discussed herein may be any type of connection suitable to transfer signals from or to the respective nodes, units or devices, for example via intermediate devices. Accordingly, unless implied or stated otherwise, the connections may for example be direct connections or indirect connections. The connections may be illustrated or described in reference to being a single connection, a plurality of connections, unidirectional connections, or bidirectional connections. However, different embodiments may vary the implementation of the connections. For example, separate unidirectional connections may be used rather than bidirectional connections and vice versa. Also, plurality of connections may be replaced with a single connection that transfers multiple signals serially or in a time multiplexed manner. Likewise, single connections carrying multiple signals may be separated out into various different connections carrying subsets of these signals. Therefore, many options exist for transferring signals.

Although specific conductivity types or polarity of potentials have been described in the examples, it will be appreciated that conductivity types and polarities of potentials may be reversed.

Each signal described herein may be designed as positive or negative. pnp devices may be used instead of npn devices, and npn devices may be used instead of pnp devices.

Those skilled in the art will recognize that the boundaries between blocks are merely illustrative and that alternative embodiments may merge blocks or circuit elements or impose an alternate decomposition of functionality upon various blocks or circuit elements. Thus, it is to be understood that the architectures depicted herein are merely exemplary, and that in fact many other architectures can be implemented which achieve the same functionality. A transistor e.g. may be a bipolar junction transistor, a field effect transistor, a MOSFET (metal-oxide-semiconductor field-effect transistor), JFET (junction gate field-effect transistor) or any other kind of transistor. For different transistors, different types of transistors may be utilized. For example, the type of transistor used for one of the transistors of the input differential pair may be different from the type of transistor used for the gate transistors. Any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermediate components. Likewise, any two components so associated can also be viewed as being "operably connected," or "operably coupled," to each other to achieve the desired functionality.

Also for example, in one embodiment, the illustrated examples may be implemented as circuitry located on a single integrated circuit or within a same device. For example, the transistors may be implemented on a common substrate. Alternatively, the examples may be implemented as any number of separate integrated circuits or separate devices interconnected with each other in a suitable manner. Also for example, the examples, or portions thereof, may implemented as soft or code representations of physical circuitry or of logical representations convertible into physical circuitry, such as in a hardware description language of any appropriate type.

The semiconductor substrate described herein can be any semiconductor material or combinations of materials, such as gallium arsenide, silicon germanium, silicon-on-insulator (SOI), silicon, monocrystalline silicon, the like, and combinations of the above.

However, other modifications, variations and alternatives are also possible. The specifications and drawings are, accordingly, to be regarded in an illustrative rather than in a restrictive sense.

In the claims, any reference signs placed between parentheses shall not be construed as limiting the claim. The word 'comprising' does not exclude the presence of other elements or steps then those listed in a claim. Furthermore, the terms "a" or "an," as used herein, are defined as one or more than one. Also, the use of introductory phrases such as "at least one" and "one or more" in the claims should not be construed to imply that the introduction of another claim element by the indefinite articles "a" or "an" limits any particular claim containing such introduced claim element to inventions containing only one such element, even when the same claim includes the introductory phrases "one or more" or "at least one" and indefinite articles such as "a" or "an." The same holds true for the use of definite articles. Unless stated otherwise, terms such as "first" and "second" are used to arbitrarily distinguish between the elements such terms describe. Thus, these terms are not necessarily intended to indicate temporal or other prioritization of such elements.

The mere fact that certain measures are recited in mutually different claims does not indicate that a combination of these measures cannot be used to advantage.

The invention claimed is:

1. A reference voltage source, comprising:

a bandgap voltage reference circuit having a first node and an output node, the output node being arranged for providing a reference voltage; and a curvature correction circuit having an input node connected to one or more of the output node, a base of a first bipolar device of the bandgap voltage reference circuit, and a base of a second bipolar device of the bandgap voltage reference circuit, wherein;

the curvature correction circuit comprises an output node connected to the first node of the bandgap voltage reference circuit, the curvature correction circuit comprises a current source for providing a current having a different temperature dependency than a temperature dependency of a first current through the first bipolar device of the bandgap voltage reference circuit; and wherein the current source comprises a modified Wilson current mirror, wherein a gate of a control transistor of the modified Wilson current mirror is connected to a collector of a third bipolar device and an output node of the modified Wilson current mirror is connected to an emitter of the third bipolar device.

2. The reference voltage source of claim 1, wherein the first and the second bipolar device are arranged to work with different emitter current densities, and an emitter of the first bipolar device or an emitter of the second bipolar device is connected to the first node.

3. The reference voltage source of claim 1, wherein the first node is arranged between an emitter of the first bipolar device and an emitter of the second bipolar device.

4. The reference voltage source of claim 1, wherein the base of at least one of the first bipolar device and the second bipolar device and the third bipolar device is connected to the output node of the bandgap voltage reference circuit.

5. The reference voltage source of claim 1, wherein the reference voltage source comprises a feedback control having a first and a second input terminal, wherein the first input terminal is arranged to be fed by a signal representative for a strength of a collector current through the first bipolar device, wherein the second input terminal is arranged to be fed by a signal representative for a strength of a collector current through the second bipolar device, wherein an output terminal of the feedback control is connected to a base of the first bipolar device and to a base of the second bipolar device.

6. The reference voltage source of claim 1, wherein the current source comprises a Vbe/R bias source.

7. The reference voltage source of claim 1, wherein the current source comprises a current source for providing an output current, which is proportional to absolute temperature.

8. The reference voltage source of claim 2, wherein the third bipolar device is arranged to work at a reference temperature $T_R$ with a same emitter current density as the emitter current density of the first bipolar device or of the second bipolar device.

9. The reference voltage source of claim 2, wherein the bandgap voltage reference circuit comprises a second resistor between the emitter of the first bipolar device and the emitter of the second bipolar device.

10. The reference voltage source of claim 3, wherein the bandgap voltage reference circuit comprises a first resistor between the emitter of the first bipolar device and a first terminal of a power supply.

11. The reference voltage source of claim 6, wherein the reference voltage source comprises a circuit for controlling an input current of the Vbe/R bias source in dependency of a strength of at least one of the collector current through the first bipolar device and the collector current through the second bipolar device.

12. The reference voltage source of claim 7, wherein the reference voltage source comprises a circuit for controlling the output current, which is proportional to absolute temperature in dependency of a strength of at least one of the collector current through the first bipolar device and the collector current through the second bipolar device.

13. The reference voltage source of claim 7, wherein the current source comprises a node for summing up an output current of the Vbe/R bias source and the output current of the current source for providing a current which is temperature independent.

14. The reference voltage source of claim 10, wherein a base of the third bipolar device is connected to the output node of the bandgap voltage reference circuit.

15. The reference voltage source of claim 14, wherein a third resistor forms a link between an emitter of the third bipolar device and the first node of the reference voltage source.

16. The reference voltage source of claim 15, wherein a ratio of the value of the third resistor divided by the value of the first resistor is $(x_1-x_3)/(n-x_1)$; wherein $x_1$ represents a power of temperature dependency of the collector current of the first bipolar device under operating conditions; wherein x.sub.3 represents a power of temperature dependency of the collector current of the third bipolar device under operating conditions; and wherein n has the value of 4 minus a power of a temperature dependency of a mobility for minority carriers.

17. A method of providing a reference voltage, comprising:

providing a first collector current through a collector of a first bipolar device, wherein a value of the first collector current has a first temperature dependency, wherein the first collector current causes a first current density at an emitter of the first bipolar device;

providing a second collector current through a collector of a second transistor, wherein the second collector current causes at an emitter of the second bipolar device a second current density, wherein the second current density is lower than first current density; and providing a third current through a collector of a third bipolar device, the third current provided by a modified Wilson current mirror connected to an emitter of the third bipolar device, wherein a gate of a control transistor of the modified Wilson current mirror is connected to the collector of the third bipolar device, and wherein a value of the third current has a second temperature dependency, wherein the second temperature dependency is different to the first temperature dependency.

18. A reference voltage source, comprising:

a bandgap voltage reference circuit having a first bipolar device, a second bipolar device, a first node and an output node, the output node being arranged for providing a reference voltage; and a curvature correction circuit having a third bipolar device, a base of the third bipolar device connected to the output node, a base of the first bipolar device, and a base of the second bipolar device, wherein:

the curvature correction circuit comprises an output node connected to the first node of the bandgap voltage reference circuit, and the curvature correction circuit comprises a current source for providing a current having a different temperature dependency than a temperature dependency of a first current through the first bipolar device of the bandgap voltage reference circuit.

19. The reference voltage source of claim 18, wherein the first and the second bipolar device are arranged to work with different emitter current densities, and an emitter of the first bipolar device or an emitter of the second bipolar device is connected to the first node.

20. The reference voltage source of claim 19, wherein the curvature correction circuit comprises a third bipolar device, wherein the third bipolar device is arranged to work at a reference temperature $T_R$ with a same emitter current density as the emitter current density of the first bipolar device or of the second bipolar device.

* * * * *